US011079713B1

(12) United States Patent
Yang et al.

(10) Patent No.: US 11,079,713 B1
(45) Date of Patent: Aug. 3, 2021

(54) CARTRIDGE HAVING ROTATABLE COUPLER

(71) Applicant: Hewlett-Packard Development Company, L.P., Spring, TX (US)

(72) Inventors: Seung Beom Yang, Seongnam-si (KR); Sung Dae Kim, Seongnam-si (KR); Dae Lim Shin, Seongnam-si (KR); Ho Jun Jang, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,105

(22) PCT Filed: Jul. 18, 2018

(86) PCT No.: PCT/KR2018/008104

§ 371 (c)(1),
(2) Date: Jun. 2, 2020

(87) PCT Pub. No.: WO2019/124661

PCT Pub. Date: Jun. 27, 2019

(30) Foreign Application Priority Data

Dec. 21, 2017 (KR) ..... 10-2017-0177589

(51) Int. Cl.
*G03G 21/16* (2006.01)
*G03G 15/08* (2006.01)
(Continued)

(52) U.S. Cl.
CPC ..... *G03G 21/1647* (2013.01); *G03G 15/0865* (2013.01); *G03G 15/757* (2013.01); *G03G 21/1676* (2013.01); *G03G 21/186* (2013.01)

(58) Field of Classification Search
CPC .. G03G 15/1865; G03G 15/757; G03G 15/80; G03G 21/1647; G03G 21/1676; G03G 21/186; F16D 1/00; F16D 1/10
See application file for complete search history.

(56) References Cited

U.S. PATENT DOCUMENTS 5,898,444 A 4/1999 Kobayashi et al.
2009/0000423 A1 1/2009 Ishikawa et al.
(Continued)

FOREIGN PATENT DOCUMENTS

CN 105843024 A 8/2016
JP 2004-198822 A 7/2004
(Continued)

*Primary Examiner* — Sophia S Chen
(74) *Attorney, Agent, or Firm* — Jefferson IP Law, LLP

(57) ABSTRACT

A cartridge which is detachably mountable in a printer main body includes a rotatable member and a coupler to rotate the rotatable member by receiving rotation power from an external source. The coupler includes a coupler body connected to the rotatable member and a coupler arm provided at the coupler body so as to be movable to a first position and a second position. The first position is farther from a center of rotation of the coupler than the second position, and the coupler arm is to push and rotate the coupler body when the rotation power is received by the coupler. The coupler also includes an elastic member to apply an elastic force to the coupler arm in a direction in which the coupler arm returns to the first position from the second position.

15 Claims, 6 Drawing Sheets

(51) Int. Cl.
*G03G 15/00* (2006.01)
*G03G 21/18* (2006.01)

(56) References Cited

U.S. PATENT DOCUMENTS

| | | | | |
|---|---|---|---|---|
| 2012/0251175 | A1 | 10/2012 | Peng et al. | |
| 2017/0146950 | A1 | 5/2017 | Moon et al. | |
| 2017/0322512 | A1* | 11/2017 | Kamoshida ..... | G03G 21/186 |

FOREIGN PATENT DOCUMENTS

| | | | |
|---|---|---|---|
| JP | 2017-521727 | A | 8/2017 |
| KR | 10-1367055 | B1 | 2/2014 |
| KR | 10-1484360 | B1 | 1/2015 |
| WO | WO-2010/024457 | A1 | 3/2010 |

* cited by examiner

[Fig. 1]
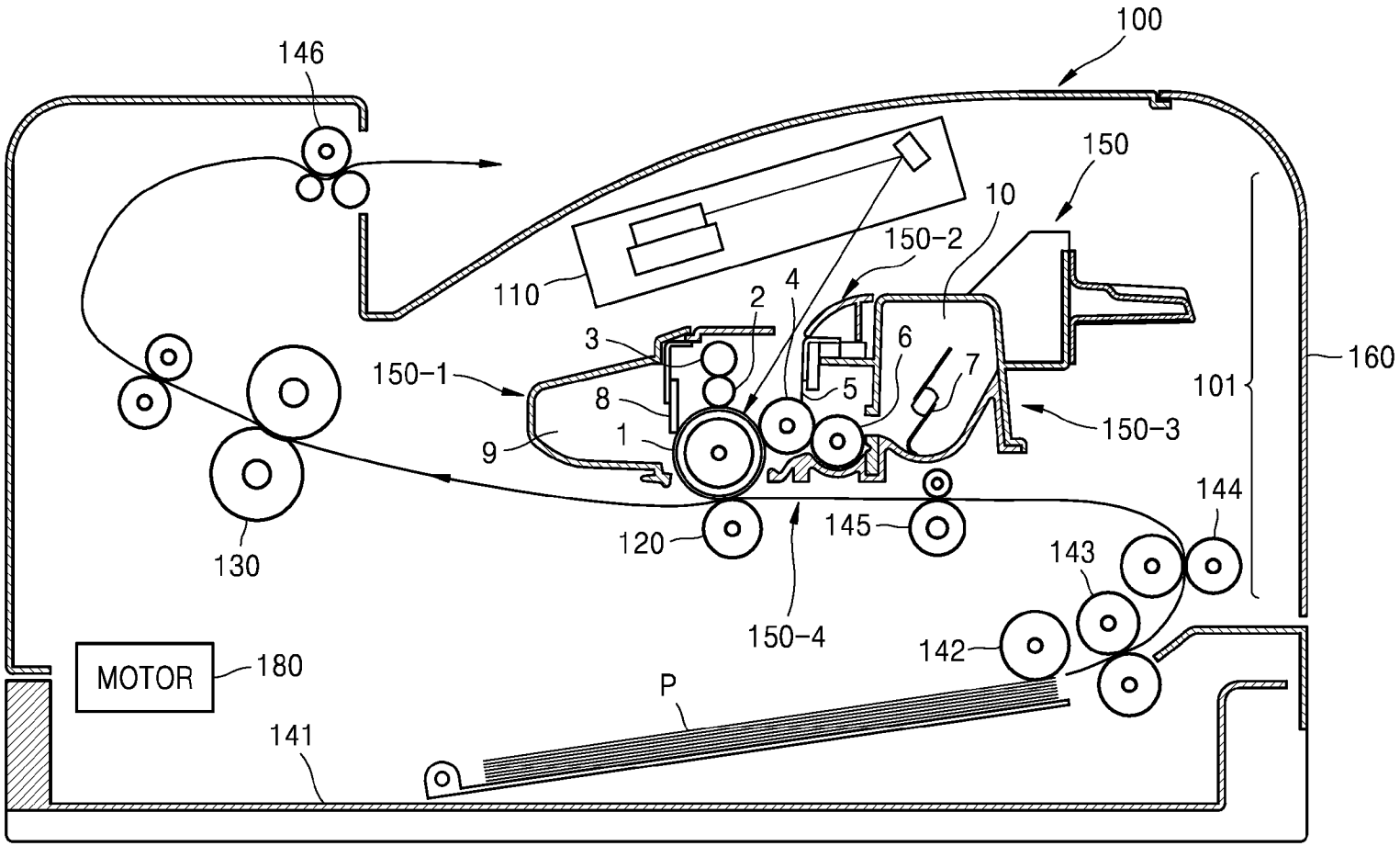

[Fig. 2]
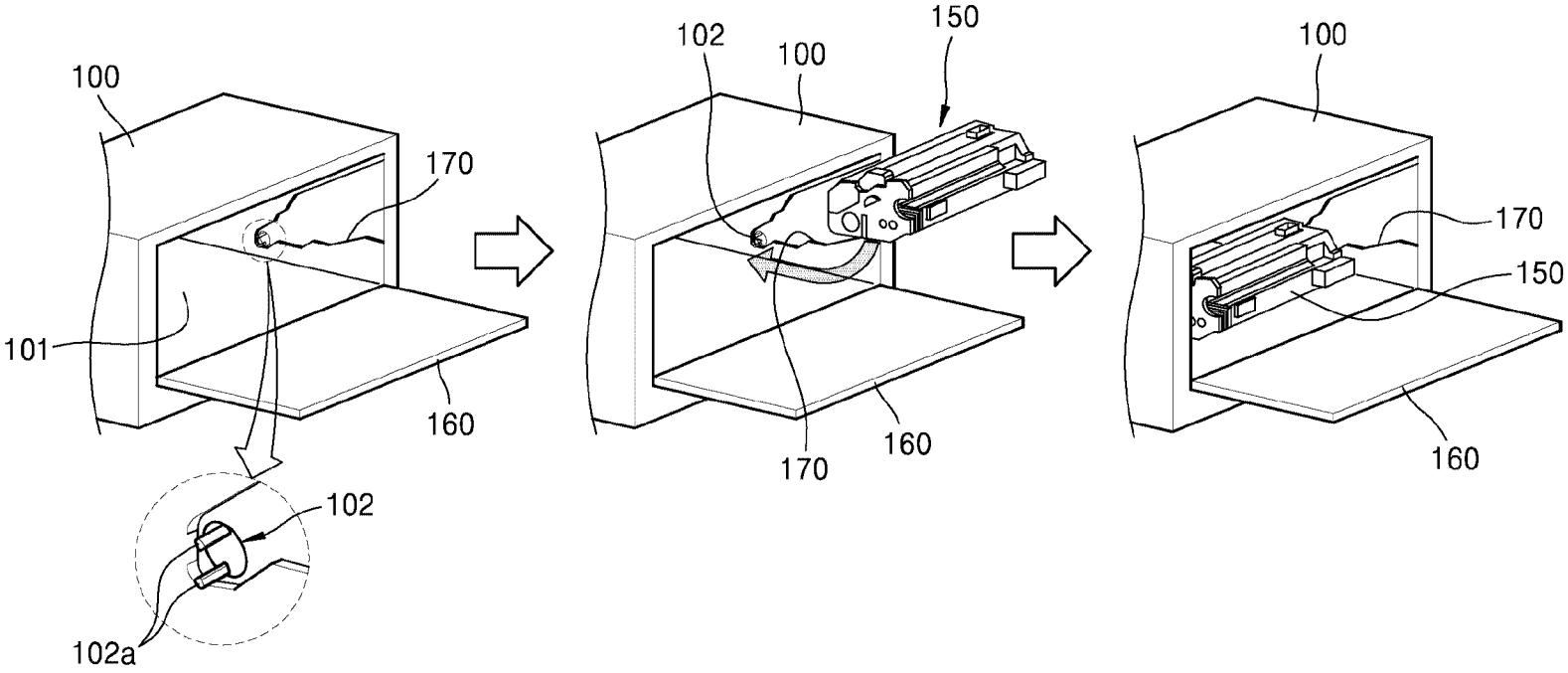

[Fig. 3]
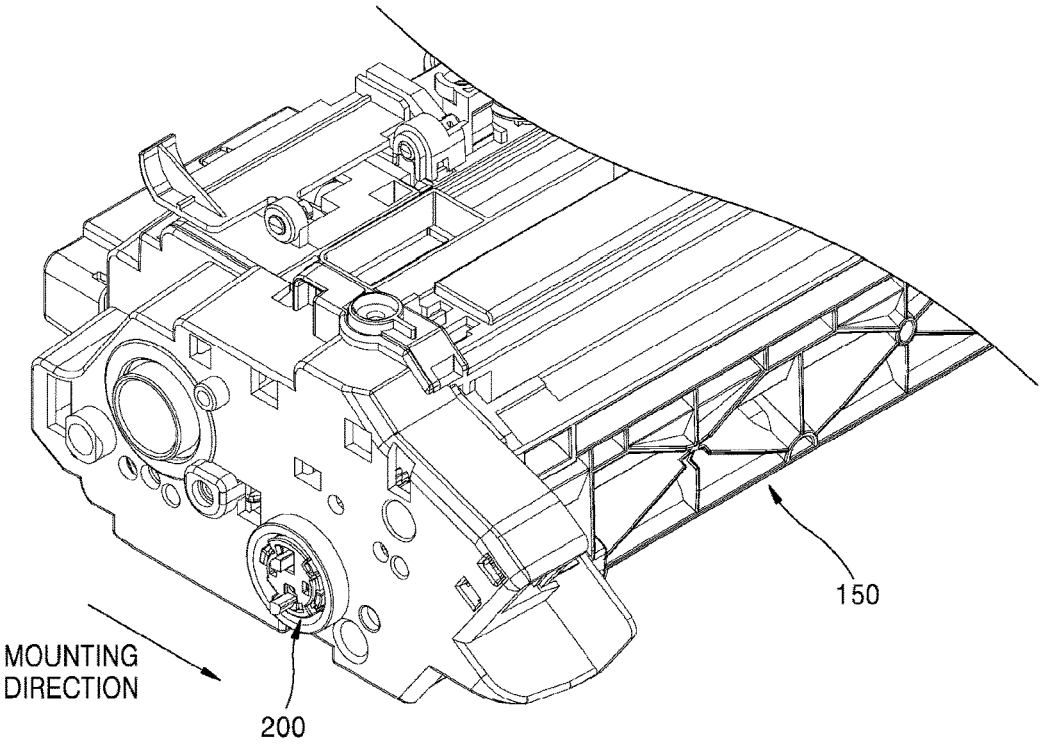
[Fig. 4]
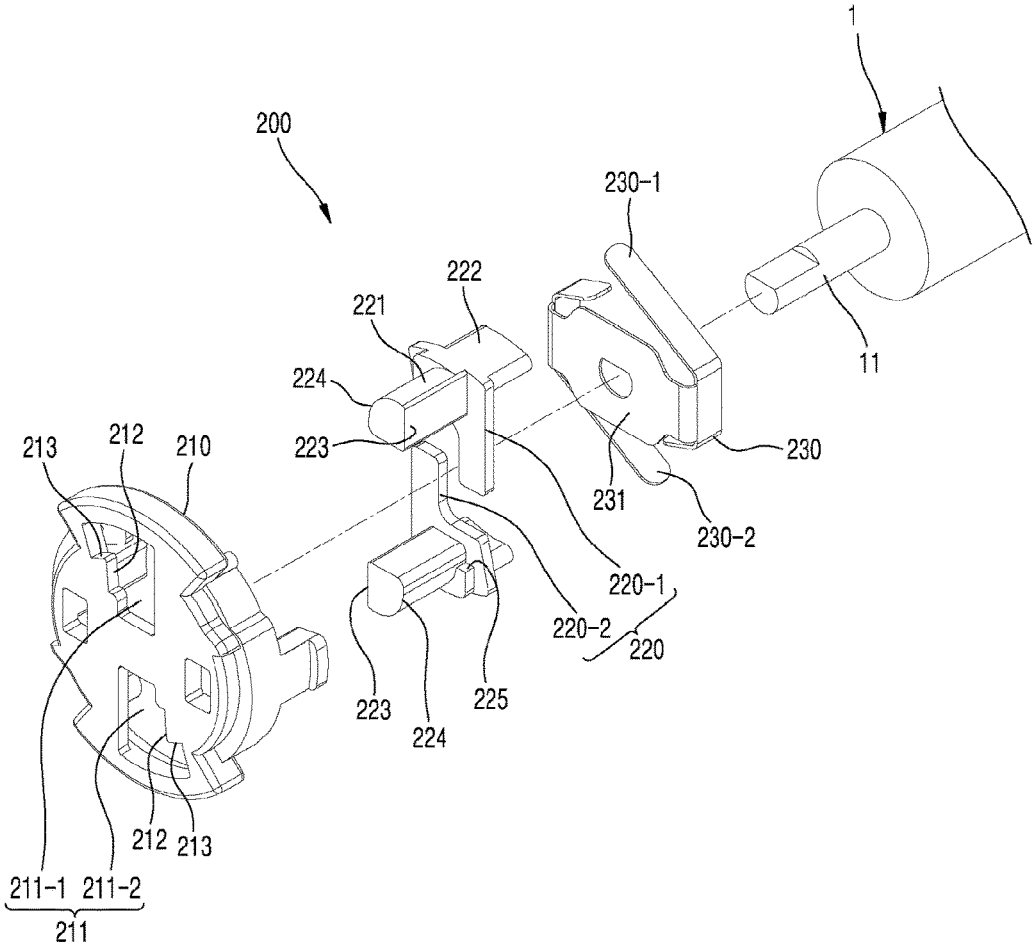

[Fig. 5]
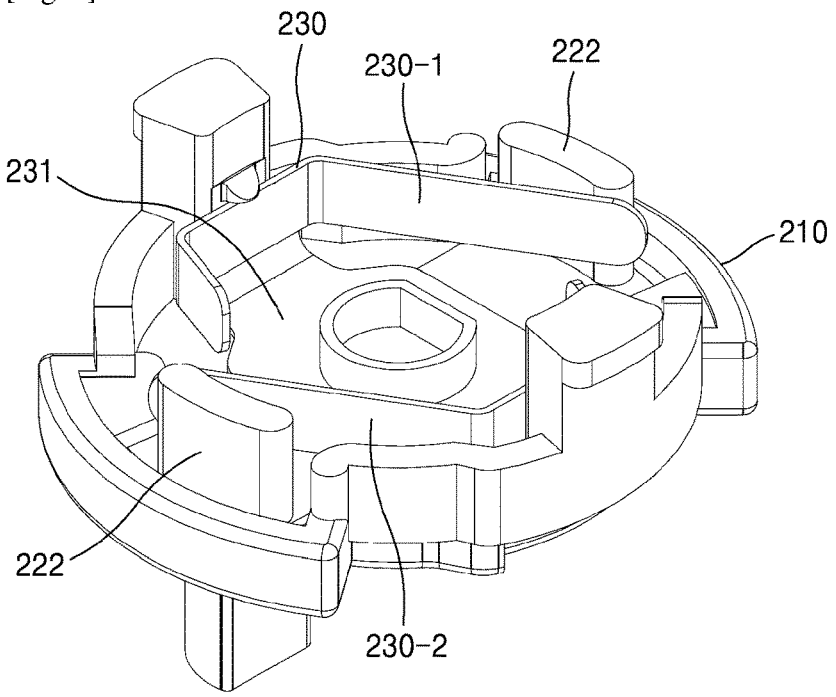
[Fig. 6]
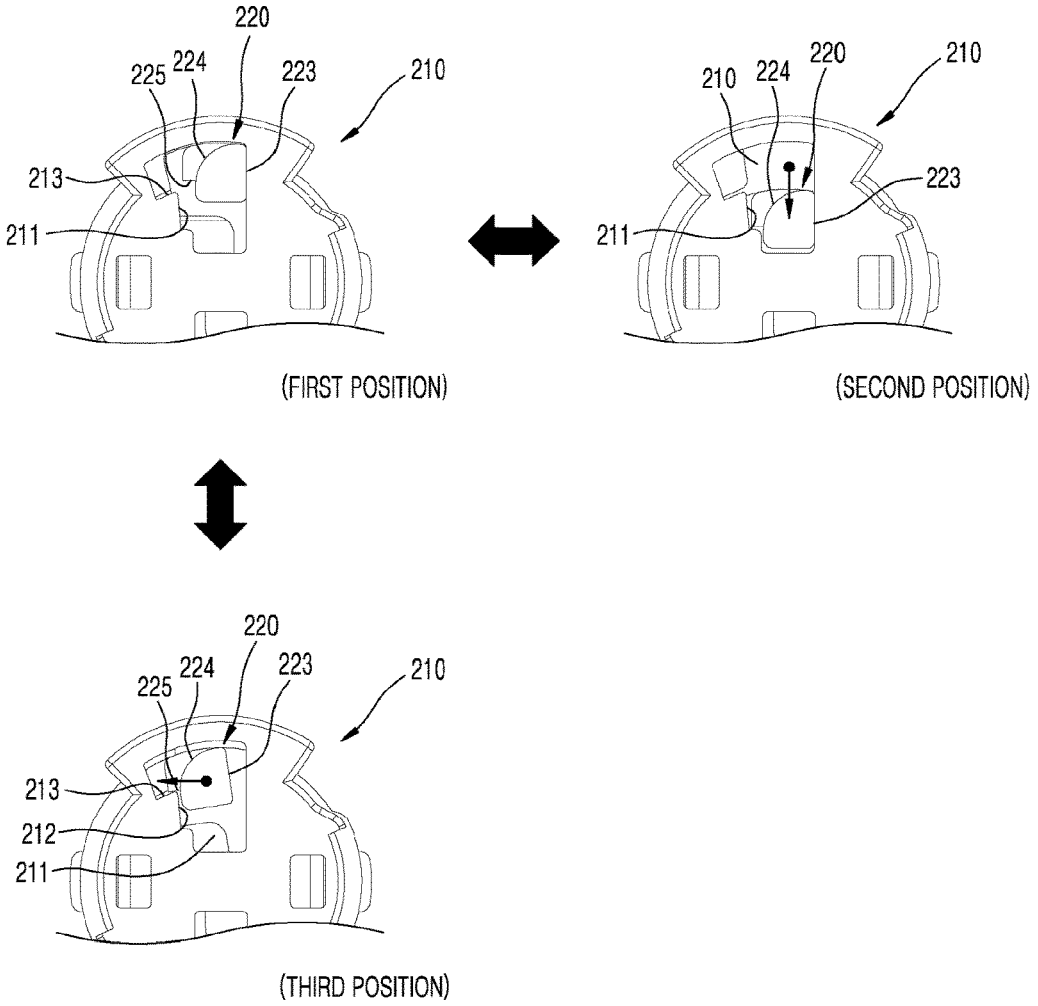

[Fig. 7]
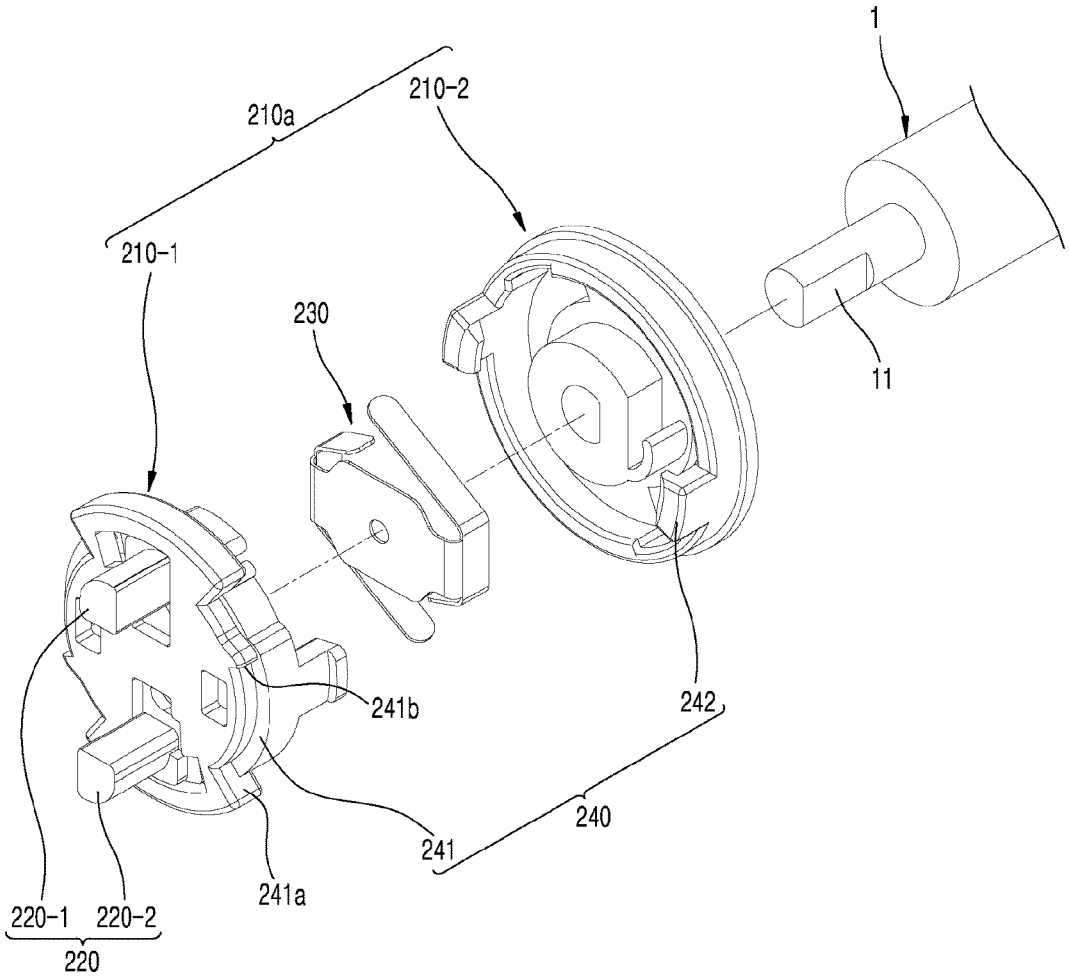

[Fig. 8]
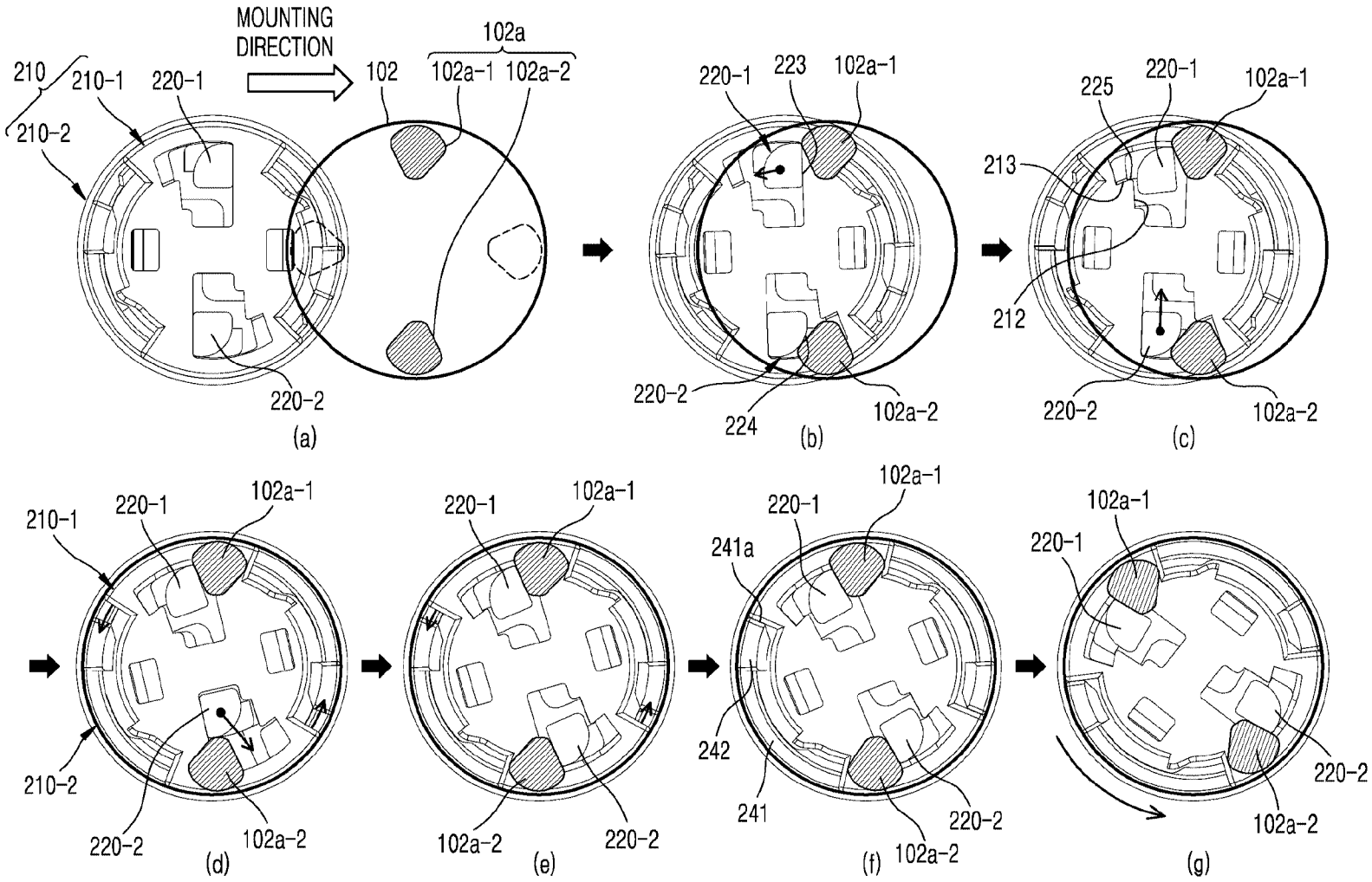

CARTRIDGE HAVING ROTATABLE COUPLER

BACKGROUND ART

Electrophotographic printers print an image onto a recording medium by forming a visible toner image on a photoconductor by supplying a toner to an electrostatic latent image formed on the photoconductor, transferring the toner image to the recording medium, and fixing the transferred toner image to the recording medium.

An electrophotographic printer has a cartridge detachably mounted in a printer main body. When the cartridge is mounted in the printer main body, rotatable members in the cartridge receive power from the printer main body. To drive the rotatable members in the cartridge, a coupler is arranged at the cartridge, and a driving power transfer member is arranged at the printer main body. The driving power transfer member may be power-connected to the coupler when the cartridge is mounted in the printer main body.

BRIEF DESCRIPTION OF DRAWINGS

FIG. 1 is a schematic configuration diagram of an electrophotographic printer, according to an example;

FIG. 2 is a perspective view illustrating an example of a cartridge being replaced;

FIG. 3 is a partially-cut perspective view of the cartridge;

FIG. 4 is an exploded perspective view of a coupler according to an example;

FIG. 5 is a perspective view of the coupler according to the example illustrated in FIG. 4;

FIG. 6 is a plan view of positions of a coupler arm;

FIG. 7 is an exploded perspective view of the coupler according to another example; and FIG. 8 illustrates a procedure of mounting the cartridge in a printer main body.

MODE FOR THE INVENTION

FIG. 1 is a schematic configuration diagram of an electrophotographic printer, according to an example. FIG. 1 illustrates a printer main body 100 and a developing device 150. The developing device 150 develops an electrostatic latent image to a visible toner image by supplying a toner in the developing device 150 to the electrostatic latent image formed on a photosensitive drum 1. The printer main body 100 may include an exposure device 110, a transfer roller 120, and a fixing device 130. Also, a recording medium transport structure for loading and transporting a recording medium P on which an image is to be formed may be arranged in the printer main body 100.

The photosensitive drum 1 is an example of a photoconductor on which the electrostatic latent image is formed, and may include a conductive metal pipe and a photosensitive layer provided at an outer circumference of the conductive metal pipe. A charging roller 2 is an example of a charger that charges a surface of the photosensitive drum 1 to have a uniform surface potential. Instead of the charging roller 2, a charging brush, a corona charger, or the like may be used. A cleaning roller 3 may remove foreign substances attached to a surface of the charging roller 2.

The exposure device 110 forms the electrostatic latent image on the photosensitive drum 1 by irradiating light to the photosensitive drum 1, the light being modulated according to image information. Examples of the exposure device 110 may include a laser scanning unit (LSU) using a laser diode as a light source, a light emitting diode (LED) exposure device using an LED as a light source, or the like.

A developing roller 4 may develop an electrostatic latent image to a visible toner image by supplying a developer (e.g., a toner) in a developer container 10 to the photosensitive drum 1. A developing bias voltage may be applied to the developing roller 4. When a one-component developing method is used, the toner may be contained in the developer container 10. When a two-component developing method is used, the toner, or the toner and a carrier may be contained in the developer container 10. A supply roller 6 supplies the toner to the developing roller 4. A supply bias voltage may be applied to the supply roller 6. An agitator 7 agitates the toner and supplies the agitated toner to the supply roller 6 and the developing roller 4. The agitator 7 may triboelectrically charge the toner by agitating the toner. A regulating member 5 regulates an amount of toner supplied, by using the developing roller 4, to a development area where the photosensitive drum 1 and the developing roller 4 face each other. The regulating member 5 may be a doctor blade that elastically contacts the surface of the developing roller 4.

The transfer roller 120 is an example of a transfer device to transfer a toner image from the photosensitive drum 1 to the recording medium P. A transfer bias voltage is applied to the transfer roller 120 so as to transfer the toner image onto the recording medium P. Instead of the transfer roller 120, a corona transfer device or a pin scorotron-type transfer device may be used.

The recording mediums P are picked up one by one from a loading table 141 by a pick-up roller 142, and are fed by feed rollers 143, 144, and 145 to an area where the photosensitive drum 1 and the transfer roller 120 face each other.

The fixing device 130 fixes the toner image on the recording medium P by applying heat and pressure to the toner image that has been transferred onto the recording medium P. The recording medium P that has passed the fixing device 130 is externally discharged from the printer main body 100 by a discharge roller 146.

A cleaning blade 8 is an example of a cleaning member that removes residual toners and foreign substances attached to the surface of the photosensitive drum 1 after a transfer process to be described below. Instead of the cleaning blade 8, a cleaning device in another form, such as a rotating brush, may be used. The toner and foreign substances that are removed by the cleaning blade 8 are contained in a waste toner container 9.

According to the aforementioned structure, the exposure device 110 scans light to the photosensitive drum 1, the light being modulated according to the image information, and forms the electrostatic latent image. The developing roller 4 forms the visible toner image on the surface of the photosensitive drum 1 by supplying the toner to the electrostatic latent image. The recording medium P loaded on the loading table 141 is transported by the pick-up roller 142 and the feed rollers 143, 144, and 145 to the area where the photosensitive drum 1 and the transfer roller 120 face each other, and the toner image is transferred onto the recording medium P from the photosensitive drum 1 due to the transfer bias voltage applied to the transfer roller 120. When the recording medium P passes the fixing device 130, the toner image is fixed on the recording medium P due to heat and pressure. The recording medium P for which fixing is completed is externally discharged by the discharge roller 146.

The developing device 150 may be replaced when its service life is over. The developing device 150 may be an integration-type development cartridge in which the photosensitive drum 1, the developing roller 4, and the developer container 10 are integrated as one body. The developing device 150 may have a structure that is divided into an imaging cartridge 150-4 including the photosensitive drum 1 and the developing roller 4, and a developer cartridge 150-3 including the developer container 10. In this case, the imaging cartridge 150-4 and the developer cartridge 150-3 may be individually replaced. The developing device 150 may have another structure that is divided into a photosensitive body cartridge 150-1 including the photosensitive drum 1, a development cartridge 150-2 including the developing roller 4, and the developer cartridge 150-3 including the developer container 10. In this case, the photosensitive body cartridge 150-1, the development cartridge 150-2, and the developer cartridge 150-3 may be individually replaced.

Hereinafter, it is assumed that the developing device 150 is the integration-type development cartridge, and the developing device 150 is referred to as the cartridge 150.

FIG. 2 is a perspective view illustrating an example in which the cartridge 150 is replaced. FIG. 3 is a partially-cut perspective view of the cartridge 150 according to an example. Referring to FIG. 2, an opening 101 is in the printer main body 100, and the cartridge 150 may be mounted in or detached from the printer main body 100 through the opening 101. A cover 160 may open and close the opening 101. A guide member 170 may be arranged in the printer main body 100 so as to guide the cartridge 150. The guide member 170 may have various forms including a rail, a groove, or the like which may guide the cartridge 150 to a mounting position. The cartridge 150, along the guide member 170, may be mounted in or detached from the printer main body 100.

The cartridge 150 may include at least one rotatable member, e.g., the photosensitive drum 1, the developing roller 4, the agitator 7, or the like. Referring to FIG. 3, the cartridge 150 may have a coupler 200 to rotate a rotatable member by receiving a rotational force from an external source. The coupler 200 may receive the rotational force from the printer main body 100. For example, when the cartridge 150 is mounted in the printer main body 100 along the guide member 170, the rotational force is transferred to the coupler 200 from the printer main body 100, and the rotatable member may rotate by being connected to the coupler 200.

As illustrated in FIG. 2, a driving power transfer member 102 may be arranged at the printer main body 100. The driving power transfer member 102 may rotate by a motor 180 in the printer main body 100. The coupler 200 may be arranged at a side of the cartridge 150, the side facing the driving power transfer member 102. The coupler 200 is protrudes outwardly from a side of the development cartridge 150 in a direction perpendicular to a direction in which the development cartridge 150 is to be mounted into the printer main body 100. When the cartridge 150 is mounted in the printer main body 100, the driving power transfer member 102 and the coupler 200 are coaxially positioned, and the driving power transfer member 102 is connected to the coupler 200 and then transfers the rotational force to the coupler 200. The at least one rotatable member of the cartridge 150 may be directly connected to the coupler 200, or may be connected to the coupler 200 via a power transfer member such as a gear, a belt, or the like. Hereinafter, examples of the coupler 200 will now be described.

FIG. 4 is an exploded perspective view of the coupler 200 according to an example. FIG. 5 is a perspective view of the coupler 200 according to the example illustrated in FIG. 4. FIG. 6 is a plan view of positions of a coupler arm 220. Referring to FIGS. 4, 5, and 6, the coupler 200 may include a coupler body 210 connected to a rotatable member, the coupler arm 220 provided at the coupler body 210, to push and rotate the coupler body 210 when the coupler receives the rotation power, and movable to a first position and a second position, the first position being farther from a center of rotation (an axis of rotation of the coupler 200) than the second position in a radial direction with respect to the center of rotation, and an elastic member 230 to apply an elastic force to the coupler arm 220 in a direction in which the coupler arm 220 returns to the first position.

The coupler body 210 may be rotatably supported by the cartridge 150. For example, the coupler body 210 may be directly combined with a rotation axis (for example, a shaft) of one of the rotatable members including the photosensitive drum 1, the developing roller 4, and the agitator 7. For example, as illustrated in FIG. 4, a shaft 11 may be a rotation axis of the photosensitive drum 1. The shaft 11 and the coupler body 210 may be connected to rotate together. For example, as illustrated in FIG. 4, a D-cut portion may be provided at the shaft 11, and a shape that is complementary with the D-cut portion may be provided in the coupler body 210. The shaft 11 may not be a rotation axis of the rotatable members. In this case, the shaft 11 may be arranged at a side of the cartridge 150 and may have a cylindrical shape without the D-cut portion. The coupler body 210 may be rotatably mounted on the shaft 11, and may be connected to at least one of the rotatable members via a not-illustrated power transfer member.

A slot 211 that is cut in a radial direction may be provided in the coupler body 210. The coupler arm 220 is inserted into the slot 211. The coupler arm 220 has an insertion portion 221 to be inserted into the slot 211. A radial-direction length of the slot 211 is greater than a radial-direction length of the insertion portion 221. Therefore, the coupler arm 220 has degrees of freedom in the radial direction in the slot 211, and may be moved to the first position and the second position in the radial direction along the slot 211, the first position being distant from the center of rotation and the second position being close to the center of rotation. The coupler arm 220 externally receives rotation power. For example, the coupler arm 220 may receive the rotation power from the driving power transfer member 102. As illustrated in FIG. 2, the driving power transfer member 102 may have a protrusion 102*a*. The insertion portion 221 is externally projected in an axial direction from the coupler body 210, and when the driving power transfer member 102 rotates, the protrusion 102*a* may push the insertion portion 221. The coupler arm 220 may rotate the coupler body 210 by pushing one wall of the slot 211.

The coupler arm 220 may have an extended portion 222 axially extending in a rear direction from the insertion portion 221. The elastic member 230 elastically pushes the extended portion 222 to the outside in the radial direction. Due to elastic force of the elastic member 230, the coupler arm 220 may return from the second position to the first position and may be maintained at the first position. For example, the elastic member 230 may be formed as a plate spring. The elastic member 230 may be combined with the coupler body 210.

When the cartridge 150 is mounted in the printer main body 100, before the cartridge 150 reaches the mounting position, the protrusion 102*a* of the driving power transfer member 102 may contact the insertion portion 221 of the coupler arm 220. In such a state, when the cartridge 150 is pushed to the mounting position, the coupler arm 220 is pushed to the second position, such that the cartridge 150 may be mounted at the mounting position. When the cartridge 150 is mounted at the mounting position, the coupler arm 220 may return to the first position due to the elastic force of the elastic member 230. When the driving power transfer member 102 rotates, the protrusion 102*a* contacts the insertion portion 221 and then the insertion portion 221 pushes one wall of the slot 211. By doing so, the coupler 200 may rotate.

According to the configuration, the driving power transfer member 102 or the coupler 200 may transfer the rotation power to the cartridge 150 without moving in an axial direction. Thus, a driving power transfer structure of the printer main body 100 and the cartridge 150 may be simplified, cost reduction may be achieved, and a size of the printer main body 100 and the cartridge 150 may become small.

The coupler arm 220 may include a first side 223 and a second side 224. The first side 223 receives the rotation power. That is, the first side 223 contacts the protrusion 102*a* when the driving power transfer member 102 rotates. The second side 224 is an opposite end of the first side 223. With respect to a rotation direction of the coupler arm 220 (or a rotation direction of the driving power transfer member 102), the first side 223 is an upstream end and the second side 224 is a downstream end. The first side 223 may have a form to easily receive the rotation direction of the driving power transfer member 102 by contacting the protrusion 102*a* when the cartridge 150 is mounted at the mounting position and then the driving power transfer member 102 rotates. The second side 224 may have a form to allow the coupler arm 220 to easily move to the second position when the protrusion 102*a* contacts the second side 224 while the cartridge 150 is being mounted at the mounting position. For example, a distance between the first side 223 and the second side 224 may be increased toward the center of rotation in the radial direction. In other words, the second side 224 faces away from the first side 223 and has one end which extends from an end of the first side 223 such that a distance between the first side 223 and the second side 224 is increased along a length of the second side 224. The second side 224 may have at least one of a curved surface and a slanted surface. The slant surface is inclined by an acute angle with respect to a tangential direction. The second side 224 may have the curved surface, the slant surface, or a combination thereof.

When the cartridge 150 is mounted in the printer main body 100, before the cartridge 150 reaches the mounting position, the protrusion 102*a* of the driving power transfer member 102 may contact the insertion portion 221 of the coupler arm 220. At this time, the protrusion 102*a* may contact the second side 224. In this state, when the cartridge 150 is pushed in a mounting direction, the coupler arm 220 is moved to the second position, such that the cartridge 150 may be mounted at the mounting position. When the cartridge 150 is mounted at the mounting position, the coupler arm 220 may return to the first position due to the elastic force of the elastic member 230. When the driving power transfer member 102 rotates, the protrusion 102*a* contacts the first side 223, and the insertion portion 221 pushes one wall of the slot 211. By doing so, the coupler 200 may rotate.

According to the configuration, when the cartridge 150 is mounted in the printer main body 100, it is not necessary to adjust a rotation phase of the driving power transfer member 102 and the coupler 200. Thus, the cartridge 150 may be mounted in the printer main body 100 through simple manipulation of sliding the cartridge 150 into the printer main body 100, so that convenience in mounting the cartridge 150 may be improved.

The coupler arm 220 may be moved to the first position, and a third position at which the coupler arm 220 pushes and rotates the coupler body 210. For example, a width of the slot 211 may be greater than a width of the coupler arm 220. In this regard, the term 'width' indicates a width in a rotation direction of the coupler body 210. Thus, the coupler arm 220 has degrees of freedom in the rotation direction in the slot 211. The coupler arm 220 at the third position contacts a wall 212 of the slot 211 in the rotation direction. The coupler arm 220 at the third position may push the wall 212 of the slot 211 by being pushed due to the protrusion 102*a*, thereby rotating the coupler body 210. The coupler arm 220 at the first position is spaced apart from the wall 212. The elastic member 230 applies the elastic force to the coupler arm 220 in a direction of returning to the first position. The coupler arm 220 is maintained at the first position due to the elastic force of the elastic member 230. The coupler arm 220 may be moved to the third position by being pushed due to the protrusion 102*a*. When the contact between the coupler arm 220 and the protrusion 102*a* is ended, the coupler arm 220 may return to the first position due to the elastic force of the elastic member 230.

The coupler 200 may further include a stopper to prevent the coupler arm 220 from being moved to the second position. The stopper may prevent the coupler arm 220 from being moved to the second position when the coupler arm 220 is located at the third position. For example, the stopper may include a first stopper 225 provided at the coupler arm 220, and a second stopper 213 provided at the coupler body 210 to hold(support) the first stopper 225 to prevent the coupler arm 220 from being moved to the second position when the coupler arm 220 is located at the third position. At the third position, the second stopper 213 is located at a position closer to the center of rotation in the radial direction than the first stopper 225 and supports the first stopper 225 to prevent the coupler arm 220 from being moved to the center of rotation in the radial direction. For example, as illustrated in FIG. 4, the first stopper 225 may be embodied as a wall in the radial direction provided at the coupler arm 220, and the second stopper 213 may be embodied as a wall in the radial direction provided at the slot 211 of the coupler body 210.

When the cartridge 150 is mounted in the printer main body 100 and then the protrusion 102*a* pushes the first side 223 of the coupler arm 220 such that the coupler 200 rotates, if the coupler arm 220 is moved to the second position, the rotation power of the driving power transfer member 102 is not transferred to the coupler 200. By using the stopper to prevent the coupler arm 220 from being moved to the second position, the rotation power of the driving power transfer member 102 may be stably transferred to the coupler 200.

The coupler 200 may include a coupler arm 220. When the coupler 200 includes a plurality of coupler arms 220, the plurality of coupler arms 220 may be arranged to be spaced apart from each other by predetermined degrees in the rotation direction with respect to the coupler body 210. The plurality of coupler arms 220 may be arranged at regular intervals. For example, as illustrated in FIG. 2, the driving power transfer member 102 may have two protrusions 102*a*, and the coupler 200 according to the rexample may include first and second coupler arms 220-1 and 220-2 that respectively correspond to the two protrusions 102*a*. The first and second coupler arms 220-1 and 220-2 may be spaced apart from each other by 180 degrees. The slot 211 may include first and second slots 211-1 and 211-2. The first and second slots 211-1 and 211-2 may be spaced apart from each other by 180 degrees. The first and second coupler arms 220-1 and 220-2 may be respectively inserted into the first and second slots 211-1 and 211-2. The elastic member 230 may include first and second elastic members 230-1 and 230-2 that respectively push the first and second coupler arms 220-1 and 220-2 to the first position. In the rexample, the elastic member 230 may include a combination body 231 to be combined with the coupler body 210, and the first and second elastic members 230-1 and 230-2 may be embodied in the form of first and second elastic arms extending from the combination body 231. Although not illustrated, the first and second elastic members 230-1 and 230-2 may be arranged as separate members and may be individually combined with the coupler body 210.

Because the coupler 200 includes at least two coupler arms, the rotation power of the driving power transfer member 102 may be smoothly transferred to the coupler 200, uniformity in rotation of the coupler 200 may be improved, and periodic defects of a printed image which is dependent on a rotation of the coupler 200 may be prevented.

When the coupler arm 220 that is pushed by the protrusion 102*a* is moved to the second position, if the coupler body 210 can slightly rotate in an opposite direction of the mounting direction, the protrusion 102*a* may be easily over the coupler arm 220, and then the cartridge 150 may be easily mounted at the mounting position. Because the coupler body 210 is connected to the rotatable members of the cartridge 150, a rotational force that is greater than a rotation load of the rotatable members has to be applied to the coupler body 210 so as to rotate the coupler body 210. The great rotational force may be generated by a force that pushes the cartridge 150 in the mounting direction. To decrease the force that pushes the cartridge 150 in the mounting direction, the coupler body 210 may be embodied in such a manner that a portion of the coupler body 210 is connected to the rotatable members with a rotation gap therebetween in the rotation direction.

FIG. 7 is an exploded perspective view of the coupler 200 according to another example. Referring to FIG. 7, a coupler body 210*a* may include a first coupler body 210-1 and a second coupler body 210-2. The first coupler body 210-1 may be equal to the coupler body 210 described with reference to FIGS. 4 through 6. For example, the first coupler body 210-1 includes the slot 211 at which the coupler arm 220 is provided. The first coupler body 210-1 may include the second stopper 213 functioning as a stopper. The elastic member 230 may be combined with the first coupler body 210-1.

The second coupler body 210-2 is connectable to the rotatable members. The second coupler body 210-2 may be directly combined with a rotation axis (for example, a shaft) of one of the rotatable members, e.g., the photosensitive drum 1, the developing roller 4, and the agitator 7. For example, as illustrated in FIG. 7, the shaft 11 may be the shaft 11 of the photosensitive drum 1. The shaft 11 and the second coupler body 210-2 may be connected to rotate together. For example, as illustrated in FIG. 7, a D-cut portion may be provided at the shaft 11, and a shape that is complementary with the D-cut portion may be provided in the second coupler body 210-2. The second coupler body 210-2 may be integrated at a side end of the rotatable member. The shaft 11 may not be a rotation axis of the rotatable members. In this case, the shaft 11 may be provided at a side of the cartridge 150 and may have a cylindrical shape without the D-cut portion. The second coupler body 210-2 may be rotatably mounted on the shaft 11, and may be connected to at least one of the rotatable members via a not-illustrated power transfer member.

The second coupler body 210-2 is coaxially mounted on the first coupler body 210-1, and is connected to the first coupler body 210-1 while having a rotation gap therebetween by a connection part 240. That is, the connection part 240 connects the first coupler body 210-1 with the second coupler body 210-2 such that the first coupler body 210-1 is rotatable by a predetermined amount without causing rotation of the second coupler body 210-2. The connection part 240 may include a first connection part 241 and a second connection part 242, wherein the first connection part 241 is provided at one of the first coupler body 210-1 and the second coupler body 210-2, and the second connection part 242 is provided at the other one and has a shape that is complementary with the first connection part 241. A width of the first connection part 241 in a rotation direction is greater than a width of the second connection part 242 in the rotation direction. For example, the first connection part 241 may have a concave shape having side walls 241*a* and 241*b*, and the second connection part 242 may have a convex shape to be inserted into the concave shape. A distance between the side walls 241*a* and 241*b* is greater than the width of the second connection part 242. The first coupler body 210-1 may have a rotation gap corresponding to a difference between the distance between the side walls 241*a* and 241*b* and the width of the second connection part 242. Thus, the first coupler body 210-1 may rotate by the rotation gap without being affected by a rotation load of a rotatable member.

According to the configuration, it is possible to mount the cartridge 150 in the printer main body 100 by using a small force, so that user convenience may be improved. When the contact between the protrusion 102*a* and the second side 224 of the coupler arm 220 is ended, the coupler arm 220 may easily return to the first position.

In general, the rotatable members of the cartridge 150 rotate in one direction. If the rotatable members rotate in a reverse direction, surfaces of the rotatable members may be damaged and members contacting the rotatable members may be damaged. For example, the cleaning blade 8 to perform cleaning on the photosensitive drum 1 contacts a surface of the photosensitive drum 1, and if the photosensitive drum 1 is rotated in a reverse direction, the surface of the photosensitive drum 1 or the cleaning blade 8 may be damaged. Also, if the developing roller 4 is rotated in a reverse direction, a surface of the developing roller 4 or the regulating member 5 may be damaged. According to the rexample, the first coupler body 210-1 and the second coupler body 210-2 are coaxially connected so as to have the rotation gap therebetween, such that it is possible to prevent or minimize reverse rotation of the rotatable members when the cartridge 150 is mounted in the printer main body 100. Thus, damage to the rotatable members due to the reverse rotation of the rotatable members may be prevented.

FIG. 8 illustrates a procedure of mounting the cartridge 150 in the printer main body 100. Hereinafter, with reference to FIGS. 2 to 8, the procedure of mounting the cartridge 150 in the printer main body 100 will now be described.

When the cover 160 is open and then the cartridge 150 is pushed into the printer main body 100 in the mounting direction, the cartridge 150 is moved to the mounting position along the guide member 170, and the coupler 200 approaches the driving power transfer member 102. The coupler arm 220 is positioned at the first position due to the elastic force of the elastic member 230.

When a phase of the coupler arm 220 is different from a phase of the protrusion 102*a*, for example, as illustrated using a broken line in (a) of FIG. 8, in a case where a difference between the phases of the coupler arm 220 and the protrusion 102*a* does not cause a contact between the coupler arm 220 and the protrusion 102*a* while the cartridge 150 is mounted, the cartridge 150 may be inserted to the mounting position. In this state, when the driving power transfer member 102 rotates, as illustrated in (g) of FIG. 8, the protrusion 102*a* contacts the first side 223 of the coupler arm 220, and the rotation power of the driving power transfer member 102 is transferred to the coupler body 210 via the coupler arm 220, such that the coupler 200 may rotate. In a case where the coupler arm 220 has a structure that is movable to the third position, the coupler arm 220 may be moved to the third position as illustrated in (g) of FIG. 8. At the third position, movement of the first coupler arm 220-1 to the second position is prevented due to the stopper, such that the rotation power of the driving power transfer member 102 may be stably transferred to the coupler 200. In a case where the coupler body 210 includes the first and second coupler bodies 210-1 and 210-2, the first coupler body 210-1 has a rotation gap with respect to the second coupler body 210-2. Thus, the first coupler body 210-1 rotates, and as illustrated in (f) of FIG. 8, after a wall 241*a* of the first connection part 241 contacts the second connection part 242, the second coupler body 210-2 also rotates.

As illustrated using a full line in (a) of FIG. 8, in a case where the phase of the coupler arm 220 is equal to the phase of the protrusion 102*a* or a difference between the phases is small, the coupler arm 220 and the protrusion 102*a* may contact each other while the cartridge 150 is mounted.

An example in which the driving power transfer member 102 includes a first protrusion 102*a*-1 and the coupler 200 includes the first coupler arm 220-1 will now be described.

As illustrated in (b) of FIG. 8, the first protrusion 102*a*-1 contacts the first side 223 of the first coupler arm 220-1. In this state, when the cartridge 150 is continuously pushed in a mounting direction, the driving power transfer member 102 and/or the coupler 200 slightly rotates such that the cartridge 150 may be moved to the mounting position. In a case where the coupler body 210 includes the first and second coupler bodies 210-1 and 210-2, the first coupler body 210-1 has a rotation gap with respect to the second coupler body 210-2. The first coupler body 210-1 that is pushed due to the first protrusion 102*a*-1 may slightly rotate with respect to the second coupler body 210-2, thereby easily moving the cartridge 150 to the mounting position with a small power. In a case where the first coupler arm 220-1 has a structure that is movable to the third position, the first coupler arm 220-1 may be moved to the third position as illustrated in (g) of FIG. 8. The first protrusion 102*a*-1 contacts the first side 223 of the first coupler arm 220-1, and the rotation power of the driving power transfer member 102 is transferred to the coupler body 210 via the first coupler arm 220-1, so that the coupler 200 may rotate. At the third position, movement of the first coupler arm 220-1 to the second position is prevented due to the stopper, such that the rotation power of the driving power transfer member 102 may be stably transferred to the coupler 200. In a case where the coupler body 210 includes the first and second coupler bodies 210-1 and 210-2, as illustrated in (f) of FIG. 8, after the wall 241*a* of the first connection part 241 contacts the second connection part 242, the second coupler body 210-2 also rotates.

An example in which the driving power transfer member 102 includes a second protrusion 102*a*-2 and the coupler 200 includes the second coupler arm 220-2 will now be described.

As illustrated in (b) of FIG. 8, the second protrusion 102*a*-2 contacts the second side 224 of the second coupler arm 220-2. In this state, when the cartridge 150 is continuously pushed in the mounting direction, as illustrated in (c) and (d) of FIG. 8, the second coupler arm 220-2 is moved to the second position by being pushed due to the second protrusion 102*a*-2, such that the cartridge 150 may be moved to the mounting position. When the driving power transfer member 102 does not rotate, the second coupler arm 220-2 is maintained at the second position. The second coupler arm 220-2 may be easily moved to the second position due to the second side 224 having the slant surface and/or the curved surface. When the driving power transfer member 102 rotates, the contact between the second protrusion 102*a*-2 and the second side 224 is ended, and the second coupler arm 220-2 returns to the first position due to the elastic force of the elastic member 230. The second protrusion 102*a*-2 contacts the first side 223 of the second coupler arm 220-2. Thus, the rotation power of the driving power transfer member 102 is transferred to the coupler body 210 via the second coupler arm 220-2, so that the coupler 200 may rotate. In a case where the second coupler arm 220-2 has a structure that is movable to the third position, the second coupler arm 220-2 may be moved to the third position as illustrated in (g) of FIG. 8. At the third position, movement of the first coupler arm 220-1 to the second position is prevented due to the stopper, such that the rotation power of the driving power transfer member 102 may be stably transferred to the coupler 200.

In a case where the coupler body 210 includes the first and second coupler bodies 210-1 and 210-2, the first coupler body 210-1 has a rotation gap with respect to the second coupler body 210-2. Because the first coupler body 210-1 that is pushed due to the second protrusion 102*a*-2 may slightly rotate with respect to the second coupler body 210-2, the contact between the second protrusion 102*a*-2 and the second coupler arm 220-2 is maintained as illustrated in (b) of FIG. 8, and the cartridge 150 may be moved to the mounting position. Thus, it is possible to easily move the cartridge 150 to the mounting position with a small power. In this state, when the driving power transfer member 102 rotates by nearly 360 degrees, the second protrusion 102*a*-2 contacts the first side 223 of the second coupler arm 220-2. The first coupler body 210-1 first rotates, and as illustrated in (f) of FIG. 8, after the wall 241*a* of the first connection part 241 contacts the second connection part 242, the rotation power of the driving power transfer member 102 is transferred to the second coupler body 210-2, so that the coupler 200 may rotate. In a case where the second coupler arm 220-2 has the structure that is movable to the third position, the second coupler arm 220-2 may be moved to the third position as illustrated in (g) of FIG. 8. At the third position, movement of the first coupler arm 220-1 to the second position is prevented due to the stopper, such that the rotation power of the driving power transfer member 102 may be stably transferred to the coupler 200.

An example in which the driving power transfer member 102 includes both the first and second protrusions 102*a*-1 and 102*a*-2, and the coupler 200 includes both the first and second coupler arms 220-1 and 220-2 will now be described.

As illustrated in (b) of FIG. 8, the first protrusion 102*a*-1 contacts the first side 223 of the first coupler arm 220-1, and the second protrusion 102*a*-2 contacts the second side 224 of the second coupler arm 220-2.

In a case where the coupler arm 220 has the structure that is movable to the third position, when the cartridge 150 is continuously pushed in the mounting direction, as illustrated in (c) of FIG. 8, the first coupler arm 220-1 is moved to the third position. In this state, movement of the first coupler arm 220-1 to the second position is prevented due to the stopper. The second coupler arm 220-2 is moved from the first position to the second position by being pushed due to the second protrusion 102*a*-2. The second coupler arm 220-2 may be easily moved to the second position due to the second side 224 having the slant surface and/or the curved surface. In a case where the coupler body 210 includes the first and second coupler bodies 210-1 and 210-2, the first coupler body 210-1 has the rotation gap with respect to the second coupler body 210-2, thus, the first coupler body 210-1 may slightly rotate with respect to the second coupler body 210-2 by being pushed due to the first protrusion 102*a*-1. When the first coupler body 210-1 rotates, the second coupler arm 220-2 also rotates, therefore, the contact between the second protrusion 102*a*-2 and the second coupler arm 220-2 may be further easily and rapidly ended.

When the contact between the second protrusion 102*a*-2 and the second side 224 of the second coupler arm 220-2 is ended, the second coupler arm 220-2 returns to the first position due to the elastic force of the elastic member 230, and as illustrated in (e) of FIG. 8, the second protrusion 102*a*-2 contacts the first side 223 of the second coupler arm 220-2. When the coupler arm 220 has the structure that is movable to the third position, and the driving power transfer member 102 rotates, as illustrated in (e) of FIG. 8, the second coupler arm 220-2 is moved to the third position. In this state, movement of the second coupler arm 220-2 to the second position is prevented due to the stopper. Thus, the rotation power of the driving power transfer member 102 may be stably transferred to the coupler 200.

In a case where the coupler body 210 includes the first and second coupler bodies 210-1 and 210-2, the first coupler body 210-1 has the rotation gap with respect to the second coupler body 210-2. Thus, when the driving power transfer member 102 rotates, the first coupler body 210-1 first rotates, and as illustrated in (f) of FIG. 8, after the wall 241*a* of the first connection part 241 contacts the second connection part 242, the rotation power of the driving power transfer member 102 is transferred to the second coupler body 210-2, so that the coupler 200 may rotate.

The detachment of the cartridge 150 will now be described.

To detach the cartridge 150 from the printer main body 100, for example, the coupler arm 220 and the protrusion 102*a* are spaced apart from each other by rotating the driving power transfer member 102 in a reverse direction by preset degrees. Afterward, after the cover 160 is open, the cartridge 150 may be detached from the printer main body 100. The degrees of the reverse directional rotation may be set in such a manner that the coupler arm 220 and the protrusion 102*a* do not interfere with each other when the cartridge 150 is detached. The degrees of the reverse directional rotation may be appropriately set according to shapes and sizes of the coupler arm 220 and the protrusion 102*a*.

For example, a controller (not shown) may detect the opening of the cover 160 by using a sensor (not shown), and when the opening of the cover 160 is detected, the controller may control the motor 180 to rotate the driving power transfer member 102 in the reverse direction by the preset degrees.

For example, when the cover 160 is open, the cover 160 and the driving power transfer member 102 may be connected via a mechanical structure such as a link so as to make the driving power transfer member 102 rotate in the reverse direction. According to the mechanical structure, by opening the cover 160, the driving power transfer member 102 may rotate by degrees at which the coupler arm 220 and the protrusion 102*a* do not interfere with each other. Thus, even when power of the printer main body 100 is cut, the cartridge 150 may be easily mounted to or detached from the printer main body 100.

In the aforementioned example, it is assumed that the shaft 11 to which the coupler 200 is combined is the rotation axis of the photosensitive drum 1. However, the shaft 11 may be a rotation axis of the developing roller 4 or may be a rotation axis of the agitator 7. The three couplers 200 may be combined with rotation axes of the photosensitive drum 1, the developing roller 4, and the agitator 7, respectively. In this case, three driving power transfer members 102 that respectively correspond to the three couplers 200 may be provided in the printer main body 100. The number of the couplers 200 and mounting positions may vary based on the number and arrangement of the rotatable members, and a structure of the developing device 150.

For example, in a case where the developing device 150 is an integrated-type cartridge in which the photosensitive drum 1, the developing roller 4, and the developer container 10 are integrated as one body, the couplers 200 may be combined with the rotation axes of the photosensitive drum 1, the developing roller 4, and the agitator 7, respectively, or the coupler 200 may be combined with a rotation axis of one of the photosensitive drum 1, the developing roller 4, and the agitator 7, and the other rotatable members may be connected to the coupler 200 via a power connecting member, e.g., a gear.

For example, in a case where the developing device 150 has the structure that is divided into the imaging cartridge 150-4 including the photosensitive drum 1 and the developing roller 4, and the developer cartridge 150-3 including the developer container 10, the imaging cartridge 150-4 and the developer cartridge 150-3 may be individually replaced, and the coupler 200 may be provided at each of the imaging cartridge 150-4 and the developer cartridge 150-3.

For example, in a case where the developing device 150 has the structure that is divided into the photosensitive body cartridge 150-1 including the photosensitive drum 1, the development cartridge 150-2 including the developing roller 4, and the developer cartridge 150-3 including the developer container 10, the photosensitive body cartridge 150-1, the development cartridge 150-2, and the developer cartridge 150-3 may be individually replaced, and the coupler 200 may be provided at each of the photosensitive body cartridge 150-1, the development cartridge 150-2, and the developer cartridge 150-3.

Referring to FIG. 2, a cross-sectional shape of the protrusion 102*a* may be tapered to the center of rotation. For example, the protrusion 102*a* may have a trigonal prismshape or a fan-shaped column, which is tapered to the center of rotation. According to the configuration, when the protrusion 102*a* contacts the second side 224 of the coupler arm 220, the coupler arm 220 may be further easily moved from the first position to the second position.

While examples have been described with reference to the drawings, it will be understood that various changes in form and details may be made therein without departing from the spirit and scope as defined by the following claims.

The invention claimed is:

1. A development cartridge, comprising:

a rotatable member; and a coupler to rotate the rotatable member by receiving rotation power from an external source, the coupler including:

a coupler body connected to the rotatable member, a coupler arm, provided at the coupler body, to push and rotate the coupler body when the coupler receives the rotation power, and movable to a first position and a second position, the first position being farther from an axis of rotation of the coupler than the second position in a radial direction with respect to the axis of rotation, and an elastic member to apply an elastic force to the coupler arm in the radial direction.

2. The development cartridge of claim 1, wherein the coupler arm is movable from the first position to a third position to push and rotate the coupler body, and the elastic member is to apply the elastic force to the coupler arm to return the coupler arm to the first position from the third position.

3. The development cartridge of claim 2, wherein the coupler arm includes a first stopper, and the coupler body includes a second stopper that, when the coupler arm is at the third position, is to support the first stopper to prevent the coupler arm from being moved to the second position.

4. The development cartridge of claim 3, wherein the coupler arm includes a first side and a second side, the first side is to receive the rotation power, the second side faces away from the first side and has one end which extends from an end of the first side such that a distance between the first side and the second side is increased along a length of the second side.

5. The development cartridge of claim 4, wherein the second side includes at least one of a curved surface or a slanted surface.

6. The development cartridge of claim 1, wherein the coupler body includes:

a first coupler body at which the coupler arm is provided, a second coupler body, coaxially mounted on the first coupler body, and connectable to the rotatable member, and a connection part to connect the first coupler body with the second coupler body such that the first coupler body is rotatable by a predetermined amount without causing rotation of the second coupler body.

7. The development cartridge of claim 1, wherein the coupler body is connected to a shaft of the rotatable member, and the coupler and the shaft of the rotatable member rotate together.

8. The development cartridge of claim 1, wherein the coupler is protrudes outwardly from a side of the development cartridge in a direction perpendicular to a direction in which the development cartridge is to be mounted into a main body of a printer.

9. The development cartridge of claim 1, wherein the rotatable member includes at least one of a developing roller, a photosensitive drum, or an agitator.

10. A cartridge, comprising:

a rotatable member including at least one of a photosensitive drum, a developing roller, or an agitator; and a coupler to rotate the rotatable member by receiving rotation power from an external source, the coupler including:

a rotatable coupler body including first and second slots spaced apart from one another by 180 degrees, a first coupler arm, provided in the first slot, to push and rotate the coupler body when the coupler receives the rotation power, the first coupler arm being movable to a first position and a second position of the first slot, the first position of the first slot being farther from an axis of rotation of the coupler body than the second position of the first slot in a radial direction with respect to the axis of rotation, a second coupler arm, provided in the second slot, to push and rotate the coupler body when the coupler receives the rotation power, the second coupler arm being movable to a first position and a second position of the second slot, the first position of the second slot being farther from the axis of rotation than the second position of the second slot in the radial direction with respect to the axis of rotation, and an elastic member to apply an elastic force to the first and second coupler arms in the radial direction.

11. The cartridge of claim 10, wherein, with respect to a rotation direction of the coupler body, a width of each of the first and second slots is greater than a width of each of the first and second coupler arms, the first coupler arm is movable from the first position of the first slot to a third position of the first slot at which the first coupler arm is in contact with a wall of the first slot that faces in the rotation direction of the coupler body, the second coupler arm is movable from the first position of the second slot to a third position of the second slot at which the second coupler arm is in contact with a wall of the second slot that faces in the rotation direction of the coupler body, and the elastic member is to apply the elastic force to the first coupler arm to return the first coupler arm to the first position of the first slot from the third position of the first slot, and to apply the elastic force to the second coupler arm to return the second coupler arm to the first position of the second slot from the third position of the second slot.

12. The cartridge of claim 11, wherein the first coupler arm includes a first stopper and the second coupler arm includes another first stopper, the coupler body includes a second stopper provided in the first slot that, when the first coupler arm is at the third position of the first slot, is to support the first stopper of the first coupler arm to prevent the first coupler arm from being moved to the second position of the first slot, and the coupler body includes another second stopper provided in the second slot that, when the second coupler arm is at the third position of the second slot, is to support the another first stopper of the second coupler arm to prevent the second coupler arm from being moved to the second position of the second slot.

13. The cartridge of claim 12, wherein the first coupler arm includes a first side to receive the rotation power and a second side, having at least one of a curved surface or a slanted surface, arranged to face away from the first side of the first coupler arm, and the second coupler arm includes another first side to receive the rotation power and another second side, having at least one of a curved surface or a slanted surface, arranged to face away from the another first side of the second coupler arm.

14. The cartridge of claim 10, wherein the coupler body includes:

a first coupler body including the first and second slots, a second coupler body coaxially connected to the first coupler body and to the rotatable member, and a connection part to connect the first coupler body with the second coupler body such that the first coupler body is rotatable by a predetermined amount without causing rotation of the second coupler body.

15. A cartridge, comprising:

a shaft;

a first coupler body including a slot;

a coupler arm, provided at the first coupler body, movable along the slot to a first position, a second position, and a third position, the first position being farther from an axis of rotation of the first coupler body than the second position in a radial direction with respect to the axis of rotation, and when the coupler arm is at the third position, the coupler arm is in contact with a wall of the slot that faces a rotation direction of the first coupler body and is prevented from being moved to the second position;

an elastic member connected to the first coupler body to apply an elastic force to the coupler arm in the radial direction;

a second coupler body coaxially connected to the first coupler body and to the shaft; and a connection part to connect the first coupler body with the second coupler body such that the first coupler body is rotatable by a predetermined amount without causing rotation of the second coupler body.

* * * * *